US008360170B2

(12) United States Patent
Leuchtenberg

(10) Patent No.: US 8,360,170 B2
(45) Date of Patent: Jan. 29, 2013

(54) METHOD OF DRILLING A SUBTERRANEAN BOREHOLE

(75) Inventor: Christian Leuchtenberg, Brussels (BE)

(73) Assignee: Managed Pressure Operations PTE Ltd., Singapore (SG)

( * ) Notice: Subject to any disclaimer, the term of this patent is extended or adjusted under 35 U.S.C. 154(b) by 0 days.

(21) Appl. No.: 12/882,344

(22) Filed: Sep. 15, 2010

(65) Prior Publication Data

US 2011/0067923 A1 Mar. 24, 2011

Related U.S. Application Data

(60) Provisional application No. 61/242,772, filed on Sep. 15, 2009.

(51) Int. Cl.
*E21B 21/08* (2006.01)

(52) U.S. Cl. ..... 175/25; 175/48

(58) Field of Classification Search ..... 175/57, 175/25, 38, 48, 207

See application file for complete search history.

(56) References Cited

U.S. PATENT DOCUMENTS

| | | | | |
|---|---|---|---|---|
| 704,423 | A | 7/1902 | Allen | |
| 1,491,986 | A | 4/1924 | Greene | |
| 2,102,555 | A | 12/1937 | Dyer | |
| 2,158,356 | A | 5/1938 | Dyer | |
| 3,298,385 | A | 1/1967 | Jackson et al. | |
| 3,338,319 | A | 8/1967 | Griffin, III | |
| 3,470,971 | A | 10/1969 | Dower | |
| 3,872,932 | A * | 3/1975 | Gosselin | 173/1 |
| 4,448,267 | A | 5/1984 | Crawford, II et al. | |
| 4,462,469 | A * | 7/1984 | Brown | 175/40 |
| 4,630,675 | A | 12/1986 | Neipling et al. | |
| 4,685,520 | A | 8/1987 | McDaniel et al. | |
| 4,770,389 | A | 9/1988 | Bodine et al. | |
| 4,823,877 | A | 4/1989 | McDaniel et al. | |
| 4,867,254 | A | 9/1989 | Gavignet | |
| 5,070,949 | A | 12/1991 | Gavignet | |
| 5,080,182 | A | 1/1992 | Thompson | |
| 5,115,871 | A | 5/1992 | McCann et al. | |
| 5,431,188 | A | 7/1995 | Cove | |
| 5,628,493 | A | 5/1997 | McKnight et al. | |
| 5,975,219 | A | 11/1999 | Sprehe | |
| 6,176,323 | B1 | 1/2001 | Weirich et al. | |
| 6,244,631 | B1 | 6/2001 | Payne et al. | |
| 6,315,051 | B1 | 11/2001 | Ayling | |

(Continued)

FOREIGN PATENT DOCUMENTS

| | | | |
|---|---|---|---|
| EP | 1227215 | B1 | 7/2002 |
| EP | 1248065 | A2 | 10/2002 |

(Continued)

OTHER PUBLICATIONS

Tian et al., "Parametric Analysis of MPD Hydrolics", IADC/SPE International 108354-PP, Mar. 28, 2007, 7 pgs, Galvestion, TX.

(Continued)

*Primary Examiner* — Daniel P Stephenson
(74) *Attorney, Agent, or Firm* — Bracewell & Giuliani LLP

(57) ABSTRACT

A method of drilling a subterranean well bore using a tubular drill string is described. One embodiment of the method includes the steps of injecting a drilling fluid into the well bore via the drill string and removing the drilling fluid from an annular space in the well bore around the drill string via a return line. The method can also include oscillating the pressure of the fluid in the annular space in the well bore, and monitoring the rate of flow of fluid along the return line.

10 Claims, 8 Drawing Sheets

U.S. PATENT DOCUMENTS

Figure 1:
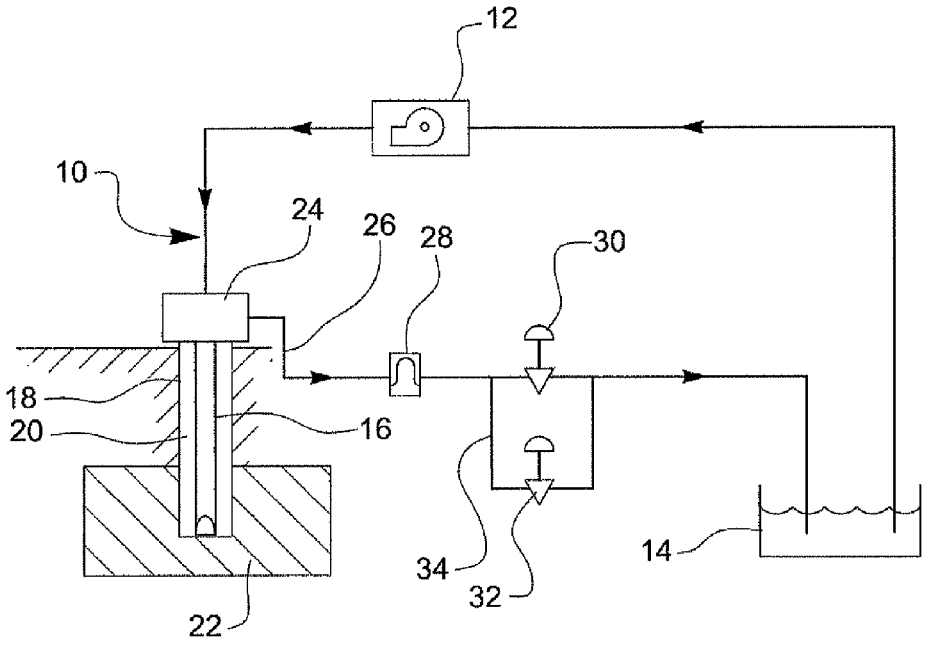

| | | | | |
|---|---|---|---|---|
| 6,374,925 | B1 | 4/2002 | Elkins et al. | |
| 6,527,062 | B2 | 3/2003 | Elkins et al. | |
| 6,714,138 | B1 * | 3/2004 | Turner et al. | 340/854.3 |
| 6,814,142 | B2 | 11/2004 | Paulk et al. | |
| 6,904,981 | B2 | 6/2005 | van Reit | |
| 7,044,237 | B2 | 5/2006 | Leuchtenberg | |
| 7,107,875 | B2 | 9/2006 | Haugen et al. | |
| 7,185,719 | B2 | 3/2007 | van Reit | |
| 7,395,878 | B2 | 7/2008 | Reitsma et al. | |
| 2003/0079912 | A1 | 5/2003 | Leuchtenberg | |
| 2003/0168258 | A1 | 9/2003 | Koederitz | |
| 2004/0069535 | A1 * | 4/2004 | Hahn et al. | 175/57 |
| 2005/0092523 | A1 | 5/2005 | McCaskill et al. | |
| 2006/0060360 | A1 | 3/2006 | Moncus et al. | |
| 2006/0124352 | A1 | 6/2006 | Krueger et al. | |
| 2006/0254822 | A1 | 11/2006 | Ayling | |
| 2006/0278434 | A1 | 12/2006 | Calderoni et al. | |
| 2007/0151762 | A1 | 7/2007 | Reitsma | |
| 2007/0231158 | A1 | 10/2007 | Butler et al. | |
| 2008/0074948 | A1 * | 3/2008 | Reckmann | 367/81 |
| 2008/0105434 | A1 | 5/2008 | Orbell et al. | |
| 2009/0025930 | A1 | 1/2009 | Iblings et al. | |
| 2009/0242817 | A1 | 10/2009 | Strazhgorodskiy | |
| 2010/0230113 | A1 * | 9/2010 | Hutin et al. | 166/373 |

FOREIGN PATENT DOCUMENTS

| | | | |
|---|---|---|---|
| EP | 1 048 819 | B1 | 2/2004 |
| EP | 1754947 | A2 | 2/2007 |
| GB | 2119046 | A | 11/1983 |
| GB | 2 290 330 | A | 12/1995 |
| GB | 2314106 | A | 12/1997 |
| GB | 2427217 | B | 10/2008 |
| GB | 2451699 | A | 2/2009 |
| WO | 0236928 | A1 | 5/2002 |
| WO | 2004074627 | A1 | 9/2004 |
| WO | 2005019596 | A1 | 3/2005 |
| WO | 2005080745 | A1 | 9/2005 |
| WO | 2007005822 | A2 | 1/2007 |
| WO | 2007081711 | A2 | 7/2007 |
| WO | 2007124330 | A2 | 11/2007 |
| WO | 2008051978 | A1 | 5/2008 |
| WO | 2008095650 | A1 | 8/2008 |
| WO | 2008156376 | A1 | 12/2008 |
| WO | 2009018173 | A2 | 2/2009 |
| WO | 2009022914 | A1 | 2/2009 |
| WO | 2010046653 | A2 | 4/2010 |

OTHER PUBLICATIONS

GB Search Report (GB 0905633.4), dated Aug. 10, 2009.
GB Search Report (GB 0905802.5), dated Jul. 31, 2009.
PCT Intl. Search Report (PCT/EP2010/054387), dated Sep. 23, 2010.
PCT Intl. Search Report (PCT/GB2010/050571), dated Dec. 17, 2010.
PCT Intl. Search Report (PCT/EP2010/063579), dated Sep. 15, 2010.
Co-pending U.S. Appl. No. 13/223,676, filed Sep. 1, 2011.
Co-pending U.S. Appl. No. 13/262,595, filed Sep. 30, 2011.
Skalle, Pal, "Trends Extracted From 800 Gulf Coast Blowouts During 1960-1996" Society of Petroleum Engineers, IADC/SPE 39354, 1998 IADC/SPE Drilling Conference held in Dallas, Texas, Mar. 3-6, 1998, pp. 539-546, Copyright 1998, IADC/SPE Drilling Conference.
Schubert, J.A. and Wright, J.C., "Early Kick Detection Through Liquid Level Monitoring in the Wellbore" Society of Petroleum Engineers, IADC/SPE 39400, 1998 IADC/SPE Drilling Conference held in Dallas, TX, Mar. 3-6, 1998, pp. 889-895, Copyright 1998, IADC/SPE Drilling Conference.
Hutchinson, M., Rezmer-Cooper, A and L. and Schlumberger, "Using Downhole Annular Pressure Measurements to Anticipate Drilling Problems" Society of Petroleum Engineers, SPE 49114, 1998 SPE Annual Technical Conference and Exhibition held in New Orleans, LA, Sep. 27-30, 1998, pp. 535-549, Copyright 1998, Society of IADC/SPE Drilling Conference.
PCT International Search Report, Dated Nov. 3, 2010, International Application No. PCT/EP2010/063579; International Filing Date: Sep. 15, 2010.

* cited by examiner

METHOD OF DRILLING A SUBTERRANEAN BOREHOLE

RELATED APPLICATIONS

This patent application claims priority to U.S. Provisional Patent Application Ser. No. 61/242,772, titled "Fracture Gradient and Pore Pressure Determination Method and System" filed on Sep. 15, 2009, which is incorporated by reference in its entirety.

DESCRIPTION OF INVENTION

The present invention relates to a method of drilling a subterranean borehole, particularly, but not exclusively, for the purpose of extracting hydrocarbons from a subterranean oil reservoir.

The drilling of a wellbore is typically carried out using a steel pipe known as a drill string with a drill bit on the lowermost end. The entire drill string may be rotated using an over-ground drilling motor, or the drill bit may be rotated independently of the drill string using a fluid powered motor or motors mounted in the drill string just above the drill bit. As drilling progresses, a flow of mud is used to carry the debris created by the drilling process out of the wellbore. Mud is pumped through an inlet line down the drill string to pass through the drill bit, and returns to the surface via the annular space between the outer diameter of the drill string and the wellbore (generally referred to as the annulus). When drilling off-shore, a riser is provided and this comprises a larger diameter pipe which extends around the drill string upwards from the well head. The annular space between the riser and the drill string, hereinafter referred to as the riser annulus, serves as an extension to the annulus, and provides a conduit for return of the mud to mud reservoirs.

Mud is a very broad drilling term, and in this context it is used to describe any fluid or fluid mixture used during drilling and covers a broad spectrum from air, nitrogen, misted fluids in air or nitrogen, foamed fluids with air or nitrogen, aerated or nitrified fluids to heavily weighted mixtures of oil or water with solid particles.

The mud flow also serves to cool the drill bit, and in conventional overbalanced drilling, the density of the mud is selected so that it produces a pressure at the bottom of the wellbore (the bottom hole pressure or BHP) which is high enough to counter balance the pressure of fluids in the formation ("the formation pore pressure"), thus substantially preventing inflow of fluids from formations penetrated by the wellbore entering into the wellbore. If the BHP falls below the formation pore pressure, an influx of formation fluid—gas, oil or water, can enter the wellbore in what is known as a kick. On the other hand, if the BHP is excessively high, it might be higher than the fracture strength of the rock in the formation. If this is the case, the pressure of mud at the bottom of the wellbore fractures the formation, and mud can enter the formation. This loss of mud causes a momentary reduction in BHP which can, in turn, lead to the formation of a kick.

Conventional overbalanced drilling can be particularly problematic when drilling through formations which are already depleted to the extent that the formation pressure has fallen below the original formation pressure, or have a narrow operational window between the BHP at which the formation will fracture ("the fracture pressure") and the formation pressure. In these cases, it is difficult to avoid drilling problems such as severe loss of circulation, kicks, formation damage, or formation collapse.

These problems may be minimised by using a technique known as managed pressure drilling, which is seen as a tool for allowing reduction of the BHP while retaining the ability to safely control initial reservoir pressures.

In managed pressure drilling, the annulus or riser annulus is closed using a pressure containment device such as a rotating control device, rotating blow out preventer (BOP) or riser drilling device. This device includes sealing elements which engage with the outside surface of the drill string so that flow of fluid between the sealing elements and the drill string is substantially prevented, whilst permitting rotation of the drill string. The location of this device is not critical, and for off-shore drilling, it may be mounted in the riser at, above or below sea level, on the sea floor, or even inside the wellbore. A flow control device, typically known as a flow spool, provides a flow path for the escape of mud from the annulus/riser annulus. After the flow spool there is usually a pressure control manifold with at least one adjustable choke or valve to control the rate of flow of mud out of the annulus/riser annulus. When closed during drilling, the pressure containment device creates a back pressure in the wellbore, and this back pressure can be controlled by using the adjustable choke or valve on the pressure control manifold to control the degree to which flow of mud out of the annulus/riser annulus is restricted.

During managed pressure drilling it is known for an operator, during drilling, to monitor and compare the flow rate of mud into the drill string with the flow rate of mud out of the annulus/riser annulus to detect if there has been a kick or if drilling fluid is being lost to the formation. A sudden increase in the volume or volume flow rate out of the annulus/riser annulus relative to the volume or volume flow rate into the drill string indicates that there has been a kick, whilst a sudden drop in the volume or volume flow rate out of the annulus/riser annulus relative to the volume or volume flow rate into the drill string indicates that the mud has penetrated the formation. Appropriate control procedures may then be implemented. Such a system is described, for example, in U.S. Pat. No. 704,423.

According to a first aspect of the invention we provide a method of drilling a subterranean well bore using a tubular drill string, the method including the steps of injecting a drilling fluid into the well bore via the drill string and removing said drilling fluid from an annular space in the well bore around the drill string via a return line, wherein the method further includes oscillating the pressure of the fluid in the annular space in the well bore, and monitoring the rate of flow of fluid along the return line.

Preferably the return line is provided with a choke which restricts the flow of fluid along the return line and which is operable to vary the degree to which the flow of fluid along the return line is restricted, and the oscillating of the pressure of the fluid in the annular space in the well bore is achieved by oscillating the choke to alternately increase and decrease the degree to which the flow of fluid along the return line is restricted.

The return line may be provided with a main choke and an auxiliary choke, the auxiliary choke being located in a branch line which extends from the return line upstream of the main choke to the return line downstream of the main choke. In this case, the oscillating of the pressure of the drilling fluid in the well bore is preferably achieved by oscillating the auxiliary choke to alternately increase and decrease the degree to which the flow of fluid along the return line is restricted.

Preferably the rate of flow of the drilling fluid along the return line is monitored using a flow meter which is connected to a processor which records the rate of flow of fluid along the return line over time.

The flow meter is preferably located in the return line upstream of the choke or chokes.

The method preferably includes the steps of comparing the rate of flow of fluid along the return line when oscillating the pressure of the fluid in the well bore prior to drilling into a formation with the rate of flow of fluid along the return line when oscillating the pressure of the fluid in the well bore whilst drilling through a formation including a reservoir of formation fluid.

The method may include the steps of, whilst drilling through a formation including a reservoir of formation fluid, progressively increasing the mean pressure of fluid in the well bore whilst oscillating the pressure of fluid in the well bore, the amplitude of the pressure oscillations being maintained at a generally constant level.

The method may include the steps of, whilst drilling through a formation including a reservoir of formation fluid, progressively decreasing the mean pressure of fluid in the well bore whilst oscillating the pressure of fluid in the well bore, the amplitude of the pressure oscillations being maintained at a generally constant level.

Figure 2:
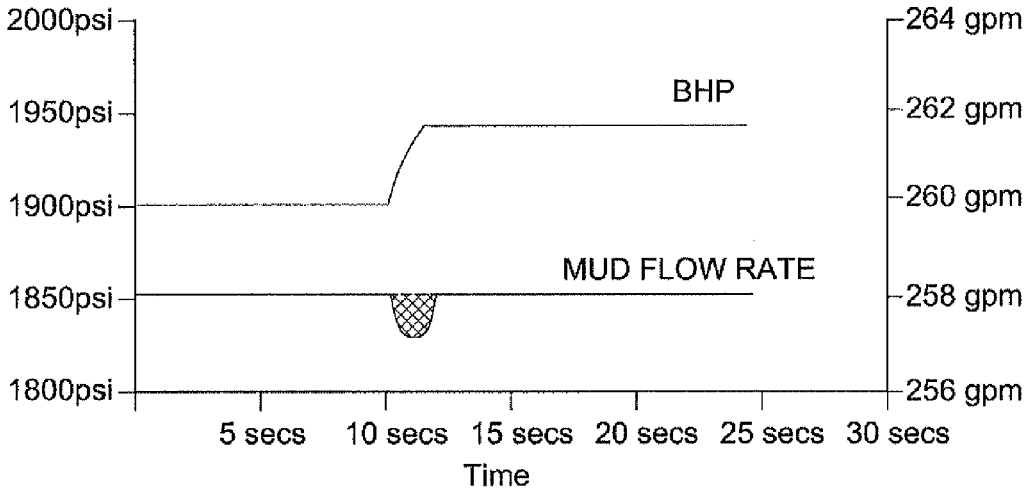
Figure 3:
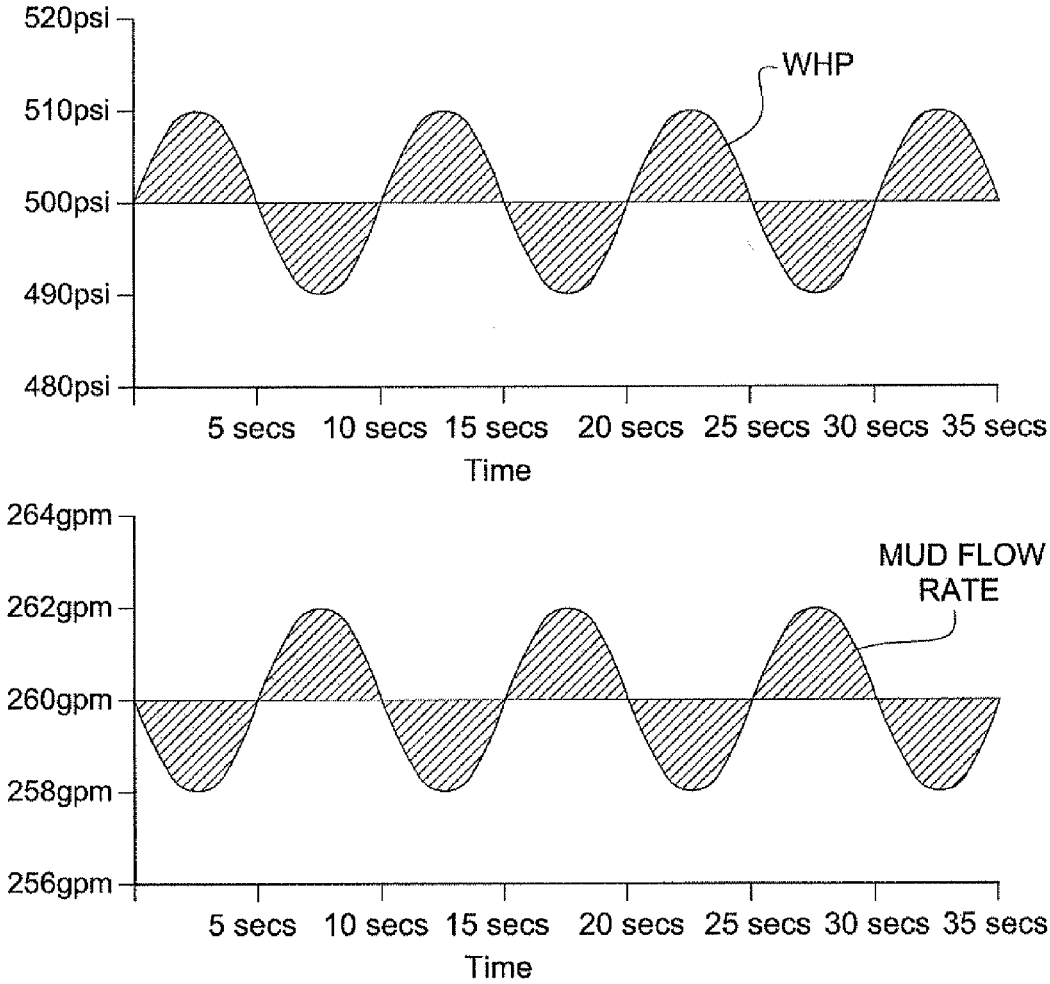
Figure 4:
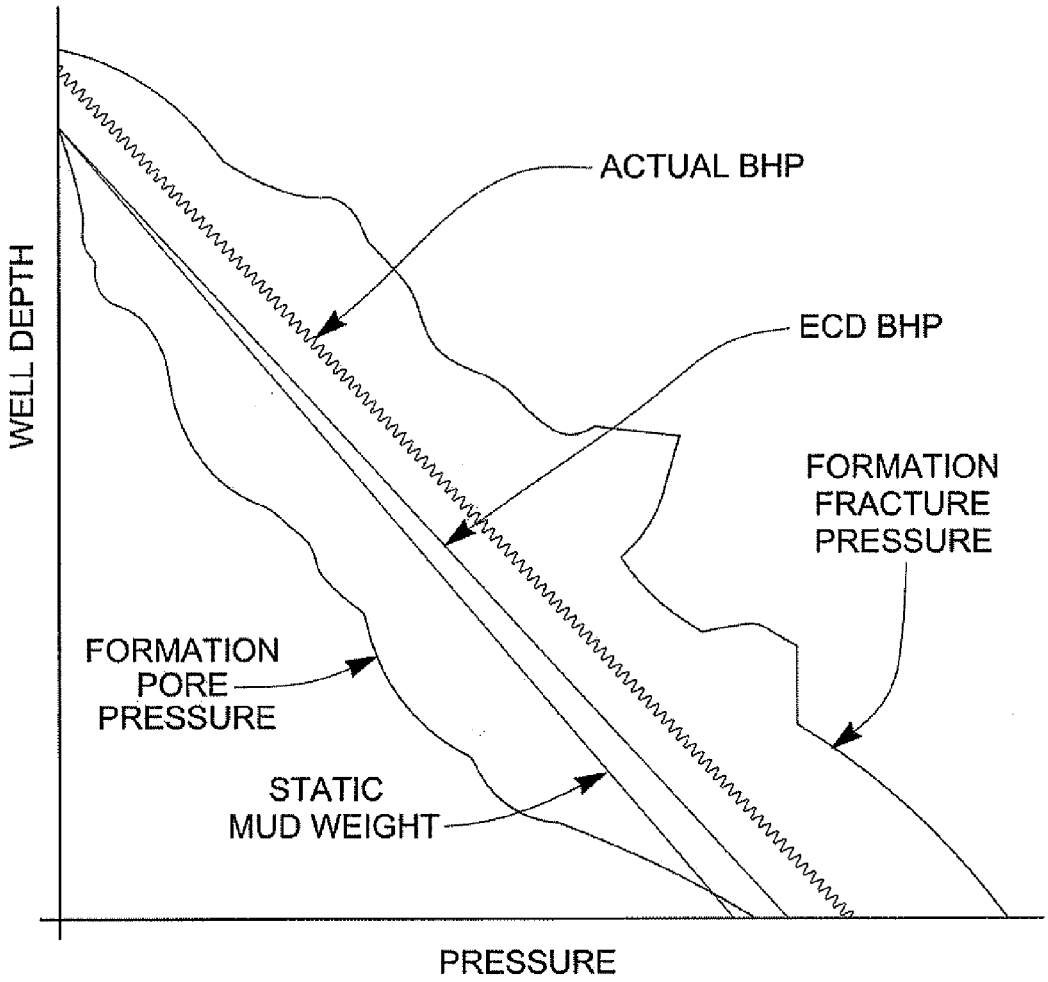
Figure 5:
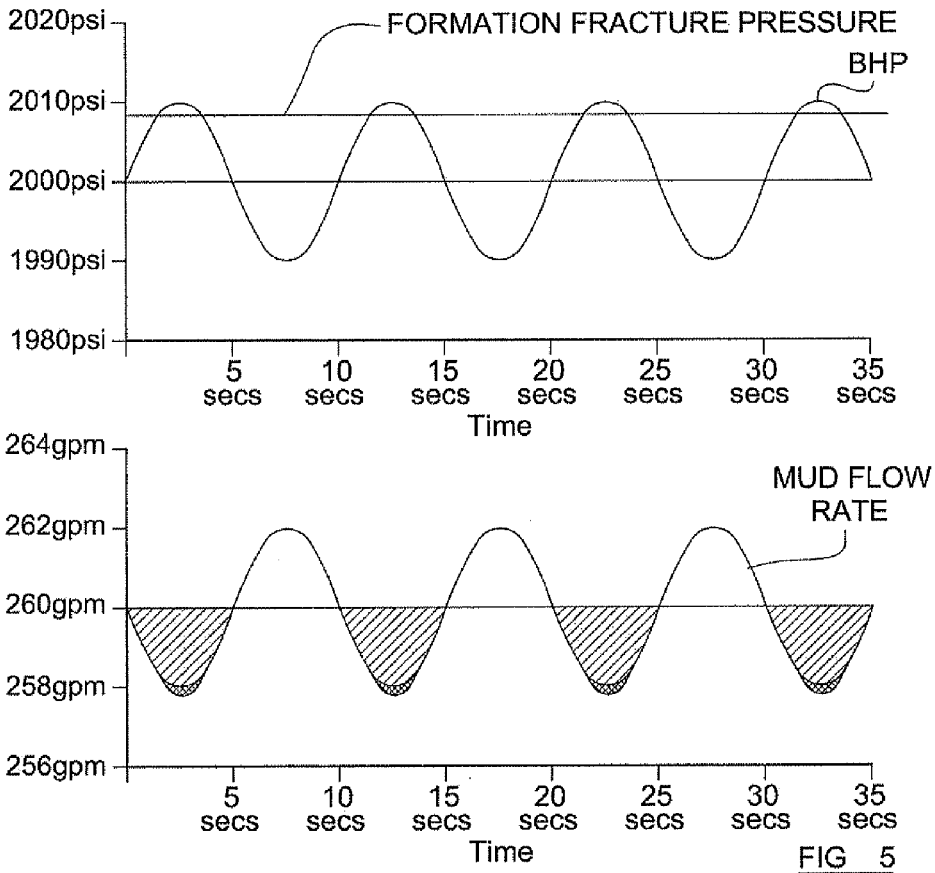
Figure 6:
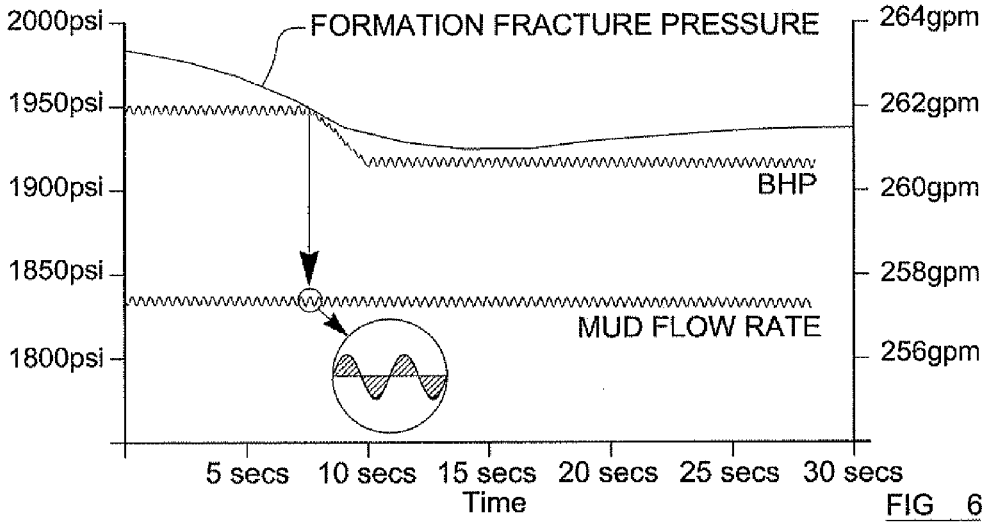
Figure 7:
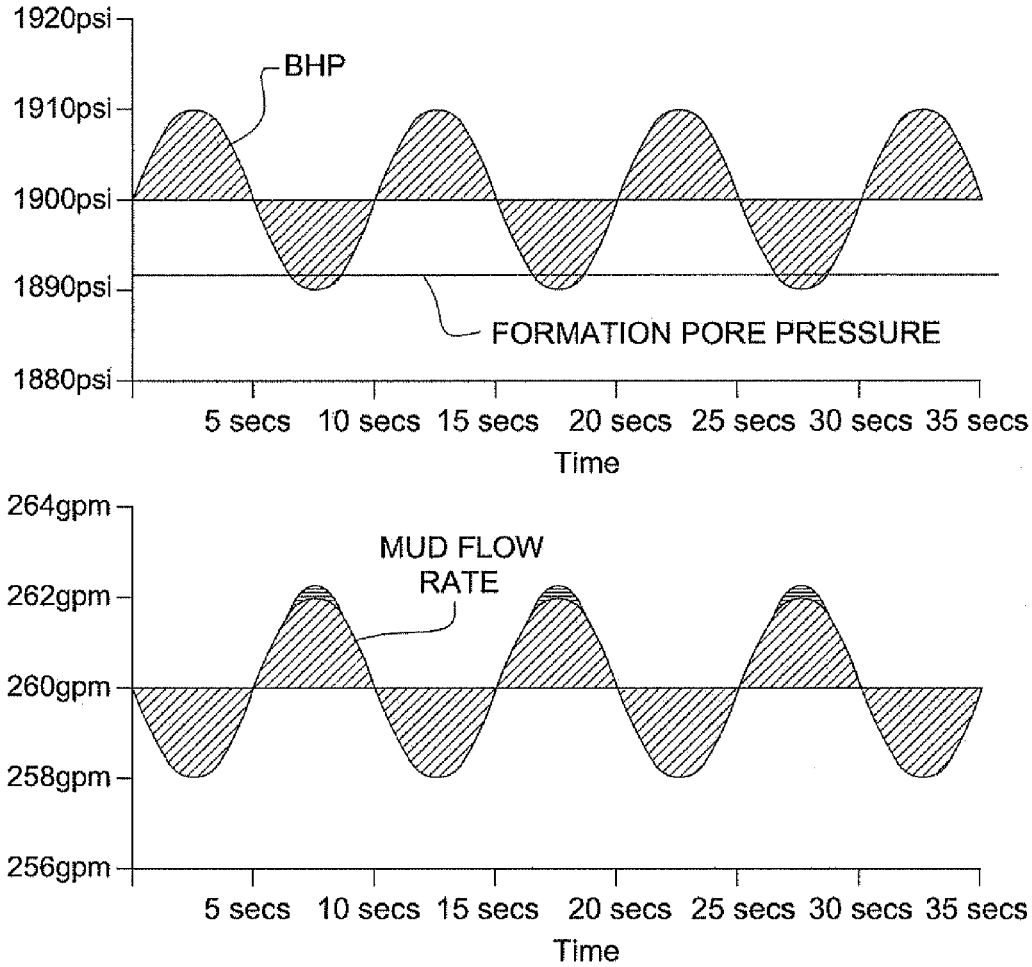
Figure 8:
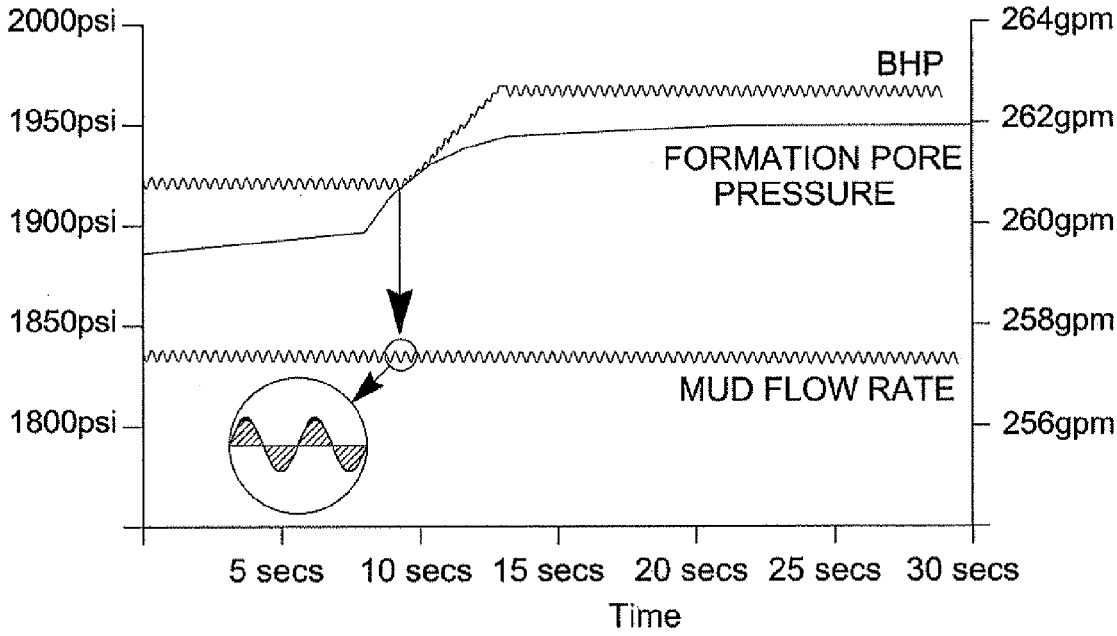
Figure 9:
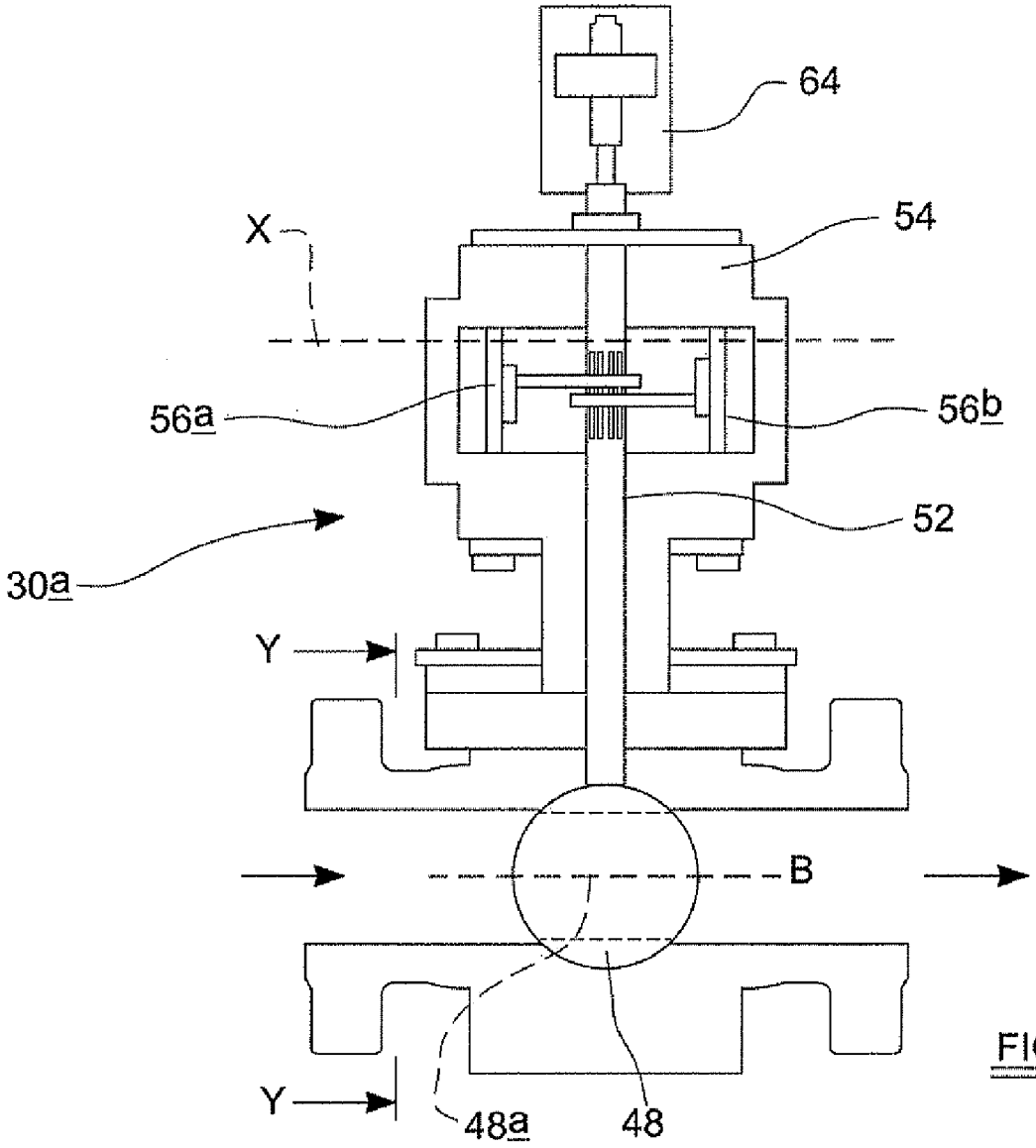
Figure 10:
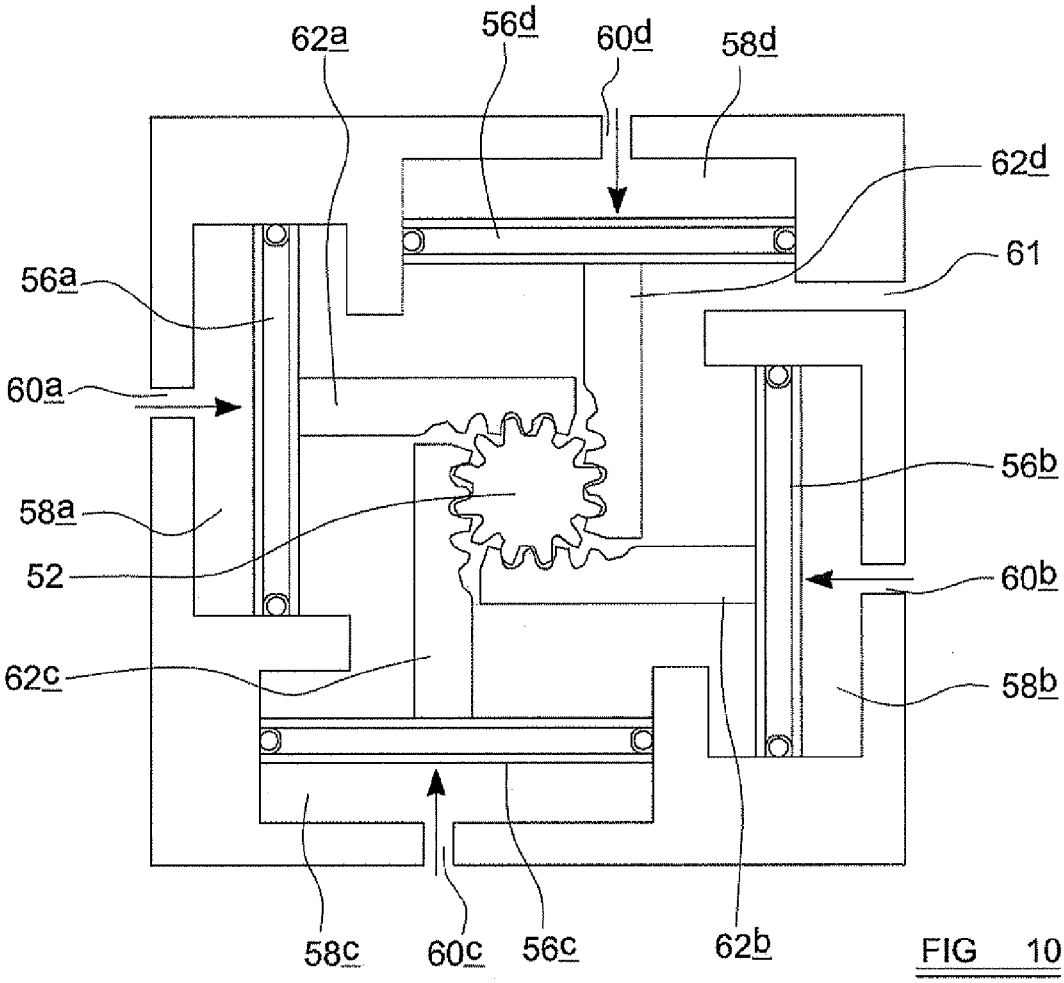
Figure 11A:
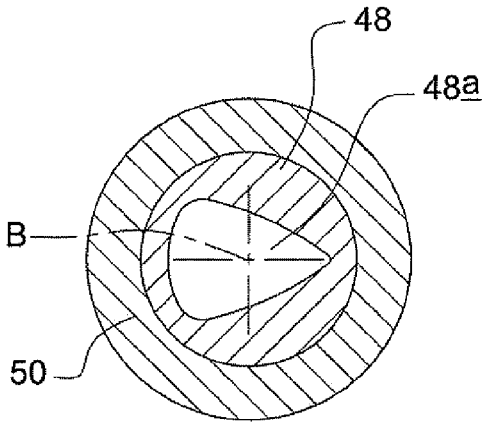
Figure 11B:
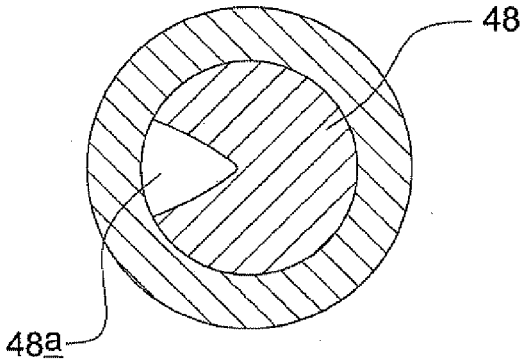

An embodiment of the invention will now be described, by way of example only, with reference to the following figures;

FIG. 1 shows a schematic illustration of a drilling system adapted for implementation of the drilling method according to the invention, FIG. 2 shows plots of BHP and returned mud flow rate over time when there is a step increase in BHP during standard managed pressure drilling, FIG. 3 shows plots of BHP and returned mud flow rate over time when the method according to the invention is used and the BHP is maintained between the formation pore pressure and the formation fracture pressure, FIG. 4 shows a plot of well depth versus pressure for an example well bore, FIG. 5 shows plots of BHP and returned mud flow rate over time when the method according to the invention is used and the BHP peaks exceed the formation fracture pressure, FIG. 6 shows plots of BHP and returned mud flow rate over time when the method according to the invention is used and the mean BHP is reduced so that the BHP peaks no longer exceed the formation fracture pressure, FIG. 7 shows plots of BHP and returned mud flow rate over time when the method according to the invention is used and the minimum BHP falls below the formation pore pressure, FIG. 8 shows plots of BHP and returned mud flow rate over time when the method according to the invention is used and the mean BHP is increased so that the minimum BHP no longer falls below the formation pore pressure, FIG. 9 shows an illustration of a cross-section through an embodiment of choke suitable for use in a drilling system according to the invention, FIG. 10 shows a plan view of a cut-away section of the choke along line X shown in FIG. 9, FIGS. 11*a* and 11*b* show a cut-away section of the choke along the line Y shown in FIG. 9, with FIG. 11*a* showing the choke in a fully open position, and FIG. 11*b* showing the choke in a partially open position.

Referring first to FIG. 1, there is shown a schematic illustration of a drilling system 10 comprising at least one mud pump 12 which is operable to draw mud from a mud reservoir 14 and pump it into a drill string 16 via a standpipe. The drill string 16 extends into a wellbore 18, and has a drill bit at its lowermost end (not shown).

As described above, the mud injected into the drill string 16 passes from the drill bit 16*a* into the annular space in the wellbore 18 around the drill string 18 (hereinafter referred to as the annulus 20). In this example, the wellbore 18 is shown as extending into a reservoir/formation 22. A rotating control device 24 (RCD) is provided to seal the top of the annulus 20, and a flow spool is provided to direct mud in the annulus 20 to a return line 26. The return line 26 provides a conduit for flow of mud back to the mud reservoir 14 via a conventional arrangement of shakers, mud/gas separators and the like (not shown).

In the return line 26 there is a flow meter 28, typically a Coriolis flow meter which may be used to measure the volume flow rate of fluid in the return line 26. Such flow meters are well known in the art, but shall be described briefly here for completeness. A Coriolis flow meter contains two tubes which split the fluid flowing through the meter into two halves. The tubes are vibrated at their natural frequency in an opposite direction to one another by energising and electrical drive coil. When there is fluid flowing along the tubes, the resulting inertial force from the fluid in the tubes causes the tubes to twist in the opposite direction to one another. A magnet and coil assembly, called a pick-off, is mounted on each of the tubes, and as each coil moves through the uniform magnetic field of the adjacent magnet it creates a voltage in the form of a sine wave. When there is no flow of fluid through the meter, these sine waves are in phase, but when there is fluid flow, the twisting of the tubes causes the sine waves to move out of phase. The time difference between the sine waves, $\delta T$, is proportional to the volume flow rate of the fluid flowing through the meter.

In the system described above, the flow meter 28 measures the returned mud flow rate.

The return line 26 is also provided with a main choke 30 and an auxiliary choke 32. The main choke 30 is downstream of the flow meter 28, and is operable, either automatically or manually, to vary the degree to which flow of fluid along the return line 26 is restricted. The auxiliary choke 32 is arranged in parallel with the main choke 30, i.e. is placed in an auxiliary line 34 off the return line 26 which extends from a point between the flow meter 28 and the main choke 30 to a point downstream of the main choke 30. In this example, the auxiliary choke 32 is movable between a closed position, in which flow of fluid along the auxiliary line 34 is substantially prevented, and a fully open position in which flow of fluid along the auxiliary line 34 is permitted substantially unimpeded by the choke 32. It will be appreciated that, whilst the pump 12 is pumping mud into the drill string 16 at a constant rate, operation of both the main choke 30 and the auxiliary choke 32 to restrict the rate of return of mud from the annulus effectively applies a back-pressure to the annulus 20, and increases the fluid pressure at the bottom of the wellbore 18 (the bottom hole pressure or BHP).

The auxiliary line 34 has a smaller diameter than the return line 26—in this example the auxiliary line 34 is a 2 inch line, whilst the return line 26 is a 6 inch line. As such, even when the auxiliary choke 32 is in the fully open position, a smaller proportion of the returning mud flows along the auxiliary line 34 than the return line 26, and operation of the auxiliary choke 32 cannot cause as much variation in the BHP as operation of the main choke 30. In this example, movement of the auxiliary choke 32 between the closed position and the fully open position causes the BHP to vary, in this example by around 10 psi (0.7 bar).

An embodiment of choke suitable for use in the invention is illustrated in FIGS. 9, 10, 11*a* and 11*b*. Whilst the chokes 30, 32 may be any known configuration of adjustable choke or valve which is operable to restrict the flow of fluid along a conduit to a variable extent, they are advantageously air configured as illustrated in FIGS. 9, 10, 11*a* and 11*b*.

Referring now to FIG. 9, there is shown in detail a choke 30*a* having a choke member 48 which is mounted in a central bore of a generally cylindrical choke body 50, the choke member 48 comprising a generally spherical ball. The choke body 50 is mounted in the annulus return line 28, annulus return relief line 28*c* or pressure relief line 28*b*' so that fluid flowing along the respective line 28, 28*c*, 28*b*' has to pass through the central bore of the choke body 50.

The diameter of the ball 48 is greater than the internal diameter of the choke body 50, and therefore the internal surface of the choke body 50 is shaped to provide a circumferential annular recess in which the ball 48 is seated. The ball 48 is connected to an actuator stem 52 which extends through an aperture provided in the choke body 50 generally perpendicular to the longitudinal axis of the central bore of the choke body 50 into an actuator housing 54. The actuator stem 52 is a generally cylindrical rod which is rotatable about its longitudinal axis within the actuator housing 54, and which has a pinion section providing radial teeth extending over at least a portion of the length of the actuator stem 52.

Referring now to FIG. 10, four pistons 56*a*, 56*b*, 56*c*, 56*d* are mounted in the actuator housing 54, the actuator housing 54 being shaped around the pistons 56*a*, 56*b*, 56*c*, 56*d* so that each piston 56*a*, 56*b*, 56*c*, 56*d* engages with the actuator housing 54 to form a control chamber 58*a*, 58*b*, 58*c*, 58*d* within the actuator housing 54. Each piston 56*a*, 56*b*, 56*c*, 56*d* is provided with a seal, in this example an O-ring, which engages with the actuator housing 54 to provide a substantially fluid tight seal between the piston 56*a*, 56*b*, 56*c*, 56*d* and the housing 54, whilst allowing reciprocating movement of the piston 56*a*, 56*b*, 56*c*, 56*d* in the housing 54. The pistons 56*a*, 56*b*, 56*c*, 56*d* are arranged around the actuator stem 52 to form two pairs, the pistons in each pair being generally parallel to one another and perpendicular to the pistons in the other pair. Four apertures 60*a* 60*b*, 60*c*, 60*d* extend through the actuator housing 54 each into one of the control chambers 58*a*, 58*b*, 58*c*, 58*d*, and a further aperture 61 extends through the actuator housing 54 into the remaining, central, volume of the housing 54 in which the actuator rod 52 is located.

Each piston 56*a*, 56*b*, 56*c*, 56*d* has an actuator rod 62*a*, 62*b*, 62*c*, 62*d* which extends generally perpendicular to the plane of the piston 56*a*, 56*b*, 56*c*, 56*d* towards the actuator stem 52. Each actuator rod 62*a*, 62*b*, 62*c*, 62*d* is provided with teeth which engage with the teeth of the pinion section of the actuator rod 52 to form a rack and pinion arrangement. Translational movement of the pistons 56*a*, 56*b*, 56*c*, 56*d* thus causes the actuator rod 52 and ball 48 to rotate.

An electrical or electronic rotation sensor 64, is, in this embodiment of the invention, mounted on the free end of the actuator stem 52 and transmits to the central drilling control unit an output signal indicative of the rotational orientation of the actuator stem 52 and ball 48 relative to the actuator housing 54 and choke body 50.

The ball 48 is provided with a central bore 48*a* which is best illustrated in FIGS. 11*a* and 11*b*. The central bore 48*a* extends through the ball 48 and has a longitudinal axis B which lies in the plane in which the longitudinal axis of the choke body 50 lies. When viewed in transverse cross-section, i.e. in section perpendicular to its longitudinal axis B, the central bore 48*a* has the shape of a sector of a circle, as best illustrated in FIG. 11*a*, i.e. has three major surfaces—one of which forms an arc and the other two of which are generally flat and inclined at an angle of around 45° to one another. As such, the central bore 48*a* has a short side where the two generally flat surfaces meet and a tall side where the arc surface extends between the two generally flat surfaces.

The ball 48 is rotatable through 90° between a fully closed position in which the longitudinal axis B of the central bore 48*a* is perpendicular to the longitudinal axis of the choke body 50, and a fully open position in which the longitudinal axis B of the central bore 48*a* coincides with the longitudinal axis of the choke body 50, as illustrated in FIGS. 10 and 11*a*. When the choke is in the fully open position, the entire cross-section of the central bore 48*a* is exposed to fluid in the choke body 50, and fluid flow through the choke body 50 is substantially unimpeded by the ball 48.

Between the fully open and fully closed position, there are a plurality of partially open positions in which a varying proportion of the cross-section of the central bore 48*a* is exposed to fluid in the choke body 50, as illustrated in FIG. 11*b*. When the choke 30*a* is in a partially open position, flow of fluid along the choke body 50 is permitted, but is restricted by the ball 48. The extent to which fluid flow is restricted depends on the proportion of the central bore 48*a* which is exposed to the fluid flow—the closer the ball 48 is to the fully open position, i.e. the greater the exposed area, the less the restriction, and the closer the ball 48 is to the fully closed position, i.e. the smaller the exposed area, the greater the restriction.

The ball 48 is oriented in the choke body 50 such that when the choke moves from the fully closed position to the fully open position, the short side of the central bore 48*a* is exposed first to the fluid in the choke body 50, the tall side of the central bore 48*a* being last to be exposed. The height of the bore 48*a* exposed to fluid in the choke body 50 thus increases as the ball 48 is rotated to the fully open position.

The central bore in a conventional ball valve is generally circular in cross-sectional area. The use of a central bore 48*a* with a sector shaped cross-section is advantageous as this ensures that there is a generally linear relationship between the angular orientation of the ball 48 and the degree of restriction of fluid flow along the choke body 50 over at least a substantial proportion of the range of movement of the ball 48. This means that it may be possible to control the back pressure applied to the annulus to a higher degree of accuracy than in prior art drilling systems.

The use of a ball valve arrangement is also advantageous because when the choke is in the fully open position, the cross-sectional area available for fluid flow along the valve body 50 is substantially the same as the flow area along the flow line into the choke. This means that if debris enters the choke and blocks the central bore 48*a* of the bail 48 when the choke is in a partially open position, the choke can be unblocked and the debris flushed away by moving the ball 48 to the fully open position.

Whilst the choke 30*a*, 30*b* can be hydraulically actuated, preferably it is pneumatically operated, in this example using compressed air. The apertures 60*a*, 60*b*, 60*c*, and 60*d* in the actuator housing 54 are connected to a compressed air reservoir and a conventional pneumatic control valve (not shown) is provided to control fluid of compressed air to the chambers 58*a*, 58*b*, 58*c*, 58*d*. Flow of pressurised fluid into the chambers 58*a*, 58*b*, 58*c*, 58*d* causes translational movement of the pistons 56*a*, 56*b*, 56*c*, 56*d* towards the actuator stem 52, which, by virtue of the engagement of the rods 62*a*, 62*b*, 62*c*, 62*d* with the pinion section of the actuator stem 52 causes the ball 48 to rotate towards the fully closed position.

Whilst return of the ball 48 to the open position could be achieved by spring loading the pistons 56*a*, 56*b*, 56*c*, 56*d* or the actuator stem 52, in this example, this is also achieved using fluid pressure. A further aperture 61 is provided in the actuator housing 54, and this aperture extends into the central space in the housing 54 which is enclosed by the pistons 56*a*, 56*b*, 56*c*, 56*d*. This aperture 61 is also connected to the compressed air reservoir via a conventional pneumatic control valve. Flow of pressurised fluid through the further aperture 61 into this central space causes translational movement of the pistons 56*a*, 56*b*, 56*c*, 56*d* away from the actuator stem 52, which, by virtue of the engagement of the rods 62*a*, 62*b*, 62*c*, 62*d* with the pinion section of the actuator stem 52 causes the ball 48 to rotate towards the fully open position.

In this example, therefore, oscillation of the choke 32 is achieved by changing the fluid pressure differential across the pistons 56*a*, 56*b*, 56*c*, 56*d*. This can be achieved by supply pressurised fluid to apertures 60*a*, 60*b*, 60*c*, 60*d* whilst allowing flow of fluid out of the actuator housing 54 via aperture 61, followed by supply of pressurised fluid to aperture 61 whilst allowing flow of fluid out of the actuator housing 54 via apertures 60*a*, 60*b*, 60*c*, 60*d* and then repeating these steps.

The drilling system is operated as follows. The pump 12 is operated to pump mud from the reservoir 14 into the drill string 16, while the drill string is rotated using conventional means (such as a rotary table or top drive) to effect drilling. Mud flows down the drill string 16 to the drill bit 16*a*, out into the wellbore 18, and up the annulus 20 to the return line 26, before returning to the reservoir 14 via the flow meter 28, chokes 30, 32, mud/gas separator and shaker. The fluid pressure at the bottom of the wellbore 18, i.e. the BHP, is equal to the sum of the hydrostatic pressure of the column of mud in the wellbore 18, the pressure induced by friction as the mud is circulated around the annulus (the equivalent circulating density or ECD), and the back-pressure on the annulus resulting from the restriction of flow along the return line 26 provided by the chokes 30, 32 (the wellhead pressure or WHP). The volume flow rate of mud along the return line 26 is monitored continuously using the output from the flow meter 28.

When the system is operated in accordance with the invention, the auxiliary choke 32 is operated to move rapidly and repeatedly between the fully open and the closed positions, so that the WHP and therefore also the BHP, fluctuate. In this example, the auxiliary choke 32 is operated so that the variation is WHP and BHP takes the form of a sinusoidal wave. It should be appreciated, however, that the pressure pulses may be induced on the well bore 18 as square waves, spikes or any other wave form. By altering the speed of operation of the auxiliary choke, and the extent to which it is opened each time, the frequency and amplitude of the pressure pulses can be varied to suit the geometry and depth of the well being drilled, and the formation pressure operational window of the formation 22.

The desired frequency of this "chattering" of the auxiliary choke can be calculated according to the well depth to ensure that the resulting pressure pulses reach the bottom of the wellbore 18. For example, if the speed of sound in water is 4.4 times the speed of sound in air (i.e. 343 m/sec×4.4=1509 m/sec), and the wellbore 18 is around 6000 m deep, it can be assumed that the pressure pulses will take 4 seconds to travel the entire depth of the wellbore 18. The auxiliary choke 32 is therefore oscillated at a frequency of 5 seconds. The frequency may, of course, be increased for shallower wellbores or decreased further for even deeper wellbore, and is generally in the range of between 2 and 10 seconds.

With the 2 inch auxiliary choke described above, the amplitude of the fluctuation in the BHP being between for example 5 psi (0.3 bar) if the auxiliary choke 32 is opened only slightly for each pulse, and, for example, 50 psi (3 bar) if the auxiliary choke 32 is opened fully on each pulse. The amplitude of the fluctuations or oscillations can be set as desired for a particular drilling operation.

Without the chattering of the auxiliary choke 32, the effect of a sudden increase in the BHP on the returned mud flow rate as measured by the flow meter 28 is illustrated in FIG. 2. This shows that, for a constant inflow rate, as the BHP increases, there is a momentary decrease in the returned mud flow rate, before the returned mud flow rate increases again to its previous steady state level. This momentary dip is due to the fluid in the well bore 18 being compressed, thus enabling the wellbore to 18 to contain a greater volume of fluid than before.

The area between the actual returned mud flow rate curve and the steady state returned mud flow rate, i.e. the shaded area in FIG. 2, is known as the well storage volume. The Well Bore Storage Factor, i.e. the volume of fluid that enters the well-bore per unit change in BHP can therefore be calculated by dividing the well storage volume by the change in BHP, in this case 10 psi.

The reverse applies if there is a sudden decrease in the BHP—this causes a momentary increase in the returned mud flow rate.

It will be appreciated, therefore, that, under steady state conditions (i.e. when there is no inflow of fluid into the well bore 18 from a formation 22 and no penetration of mud into the formation 22) oscillation or "chattering" of the auxiliary choke 32 will result in a corresponding oscillation in the returned mud flow rate as illustrated in FIG. 3. The shaded area under each returned mud flow rate peak or above each returned mud flow rate trough can be used to calculate the Well Bore Storage Factor at that point.

Such steady state conditions would be achieved when drilling through a formation 22 whilst the BHP is between the formation pore pressure and the formation fracture pressure as illustrated in FIG. 4. Under these conditions, there is no mud lost to the formation 22, and there is no inflow of fluid from the formation into the well bore 18.

As discussed above, if the BHP falls below the formation pore pressure, fluid will flow from the formation 22 into the well bore 18, or if the BHP exceeds the formation fracture pressure, mud will penetrate the formation 22. Both these events will alter the well storage coefficient, as follows.

If BHP exceeds the formation fracture pressure, and mud is injected into the formation, there will be a sudden drop in the returned mud flow rate. When the auxiliary choke 32 is oscillated as described above, if, as drilling progresses, the formation fracture pressure drops so that as the BHP oscillates, the peaks exceed the formation fracture pressure, the momentary loss of mud to the formation will increase the magnitude of the drop in returned mud flow rate, as illustrated in FIG. 5. This will be detected as a sudden increase in the Well Bore Storage Factor.

It will therefore be appreciated that by monitoring the returned mud flow rate whilst oscillating the auxiliary choke as described above, it is possible to detect if the BHP has exceeded the formation fracture pressure. This allows the operator to react by reducing the mean BHP (for example by opening the main choke 30 slightly) to avoid further loss of mud to the formation 22. Typically this can be achieved within 3 or 4 oscillations of the auxiliary choke 32. This process is illustrated in FIG. 6. As the oscillations of the auxiliary choke 32 cause the BHP to exceed the formation fracture pressure only very briefly, very little mud is lost to the formation before the mud loss event is detected and the corrective action taken.

If desired, the operator can use this method to determine the formation fracture pressure. To do this, the auxiliary choke 32 is oscillated whilst the main choke 30 is operated to gradually increase the extent to which it restricts flow of fluid along the return line 26, whilst all other parameters—mud inflow rate, speed of rotation of the drill string etc. are kept constant. This results in a steady increase in the BHP. When the sudden increase in Well Bore Storage Factor resulting from the loss of mud to the formation 22 is detected, the operator knows that the formation fracture pressure has been exceeded, and can determine the formation fracture pressure from the peak BHP level at that time.

If the BHP falls below the formation pore pressure, and fluid from the formation flows into the well bore 18, there will be a sudden increase in the returned mud flow rate due to a very small momentary influx of formation fluid. When the auxiliary choke 32 is oscillated as described above, if, as drilling progresses, the formation pore pressure increases so that as the BHP oscillates, the BHP troughs fall below the formation pore pressure, the momentary influx of formation fluid into the well bore 18 will increase the magnitude of the peak in returned mud flow rate, as illustrated in FIG. 7. This will also be detected as a sudden increase in the well storage coefficient.

It will therefore be appreciated that by monitoring the returned mud flow rate whilst oscillating the auxiliary choke as described above, an influx of fluid from the formation into the well bore 18 can be detected. This allows the operator to increase the mean BHP (for example by closing the main choke 30 slightly, or by increasing the mud density) to avoid further influx. Typically this can be achieved within 3 or 4 oscillations of the auxiliary choke 32. This process is illustrated in FIG. 8.

As the oscillations of the auxiliary choke 32 cause the BHP to fall below the formation pore pressure only very briefly, relatively little formation fluid enters the well bore before this determination is made and the corrective action taken. This means that it may be possible to continue drilling whilst the negligible amount of formation fluid is circulated out of the well bore 18 with the returned mud, and separated out, for example, using the standard mud/gas separators.

If desired, the operator can use this method to determine the formation pore pressure. To do this, the auxiliary choke 32 is oscillated whilst the main choke 30 is operated to gradually decrease the extent to which it restricts flow of fluid along the return line 26, whilst all other parameters—mud inflow rate, speed of rotation of the drill string etc. are kept constant. This results in a steady decrease in the BHP. When the sudden increase in well storage coefficient resulting from the influx of fluid from the formation 22 is detected, the operator knows that the formation pore pressure has been reached, and can determine the formation pore pressure from the lowest BHP level at that time.

Using the inventive method to determine the formation fracture pressure and pore pressure can assist in improving the safety of drilling exploration wells into formations with unknown fracture pressures or pore pressures.

This method may also be used to differentiate between a formation fluid inflow or kick, and the effect of formation ballooning.

Formation ballooning occurs in lithologies, such as carbonates (limestone, chalk, dolomite) or elastics (shales, mudstones, sandstones). When the well bore pressure is reduced, these formations tend to expand. The net effect is that near the well bore the formation expands in size, which results in a reduction of the average diameter along a section of the well bore. As the average diameter is reduced, the well bore volume is reduced, temporarily increasing the flow rate out of the well bore. Conversely, when the BHP is increased, these formations tend to contract in the near vicinity of the well bore, resulting in an increase in well bore volume and a corresponding reduction in returned mud flow rate out of the well bore.

Thus, if mud flow to the drill string is stopped to connect a new portion of drill pipe to the drill string 16, the ECD frictional pressure is removed from the well, and the BHP may drop by typically 200 to 400 psi, resulting in an overall increase in both the returning mud flow rate, and a corresponding overall increase in the rigs surface mud tank (or pit) volume. This can be misinterpreted as a kick, or formation fluid inflow into the well bore 18.

Well ballooning effects can also be the result of drilling mud returning into the well bore from the near well bore face. This effect occurs after mud is forced into the near well bore face, if the lithologies exposed have the required permeability. When the overall pressure in the well bore is reduced, then some of these drilling fluids flow and are returned into the well bore.

As well bore ballooning occurs due to a reduction in overall well bore pressure, this return of near well bore invaded drilling fluids can result in an overall increase in both the returned mud flow rate out of the well bore 18/annulus 20, and an overall increase in the rigs surface mud reservoir volume. Again, in conventional overbalanced drilling or standard MPD operations, this can be misinterpreted as a kick, or formation fluid inflow into the well bore 18.

Thus, well bore ballooning effects can be a result of both the expansion of the formation lithology, and/or injected drilling fluid returns from the near well bore face permeable formations. But, both occur as the BHP is reduced across all exposed formations in the well bore.

Well bore ballooning effects are seen as after flow, or a continuation of returned mud flow, after the rig mud pumps have been stopped. Returned flow from the well can continue for some time, after the rigs pumps are stopped, and then gradually drop off, or slow down in rate. This continuation of mud return flow after the rig mud pumps are turned off can be misinterpreted as a kick, and cause a loss of rig time, as the well is shut in and kick procedures are followed.

The inventive method can be used to effectively and instantaneously differentiate between well bore ballooning effects and a kick, using two methods.

A formation fluid influx or kick will immediately be noted as momentary increase in the returned mud flow rate peaks as described above, whereas well bore ballooning will result in an overall increase in returned drilling fluid mud flow rate out of the well bore and will be seen as a different trend pattern on the flow rate out, as an overall increase not related to BHP dips.

Moreover, despite being relatively insignificant, formation fluid inflow into the well bore, resulting in returning mud flow rate peak increases in magnitude, will be larger than flow rate out increases on flow rate peaks due to well bore ballooning. This is because formation fluid inflows or kicks would normally be composed of either hydrocarbon gas, or condensate or crude oil with a proportion of gas cut, or hydrocarbon Gas Oil Ratio (GOR), whereas the well ballooning is caused in either by an influx of mud, or expansion of the formation, neither of which involve the expansion of a gas.

Thus, the system software will be configured and calibrated to differentiate between well bore ballooning and a formation fluid inflow into the well bore.

Ideally the system is calibrated by monitoring the returned mud flow rate during oscillation or "chattering" of the auxiliary choke 32 prior to drilling out the casing shoe into any open hole section. At this point it is known that no open formation is exposed to the well bore 18, and therefore there cannot be any influx of formation fluid or loss of mud to the formation. The returned mud flow rate profile at this point is therefore representative of the steady state condition illustrated in FIG. 4, and this can be compared with the returned mud flow rate profile when drilling into the formation 22 to establish if there has been formation fluid influx or mud loss.

The flow meter 28 is connected to an electronic processor which is records the volume flow rate along the return line 26 over time. The sudden change in Well Bore Storage Factor brought about by loss of mud to the formation or an influx of formation fluid into the well bore 18 can be detected in a number of ways. The processor can simply be programmed to monitor the amplitude of the volume flow rate oscillations, as a change in Well Bore Storage Factor increases these amplitudes. Alternatively, as a change in Well Bore Storage Factor manifests itself as a change in the area under a flow rate peak, or above a flow rate trough (the shaded areas in FIGS. 3, 5 and 7, and the processor can be programmed to integrate the volume flow rate v. time curve to determine these areas. Finally, for an even more sensitive analysis, the processor can be programmed to plot the differential of the volume flow rate v. time curves.

The method described in this patent can be used in various different drilling modes including managed pressure drilling with a hydrostatically underbalanced mud weight, managed pressure drilling with a hydrostatically overbalanced mud weight, and pressurised mud cap drilling. In managed pressure drilling with a hydrostatically underbalanced mud weight, the hydrostatic pressure of the column of mud is less than the formation pore pressure, and the BHP is increased to exceed the formation pore pressure by virtue of the frictional effects of circulating mud around the well bore 18 and the back pressure (WHP) applied by the chokes 30, 32. In managed pressure drilling with a hydrostatically overbalanced mud weight, the hydrostatic pressure of the column of mud is greater than the formation pore pressure, and the BHP is further increased by virtue of the frictional effects of circulating mud around the well bore 18 and the back pressure (WHP) applied by the chokes 30, 32.

Finally, pressurised mud cap drilling employs a, dual gradient/density drilling mud column with a heavier weigh or density of mud being circulated in the top portion of the well bore and a lighter weight or density mud being circulated into the well bore below the high density mud cap. The well remains totally closed and there is no return of well bore fluids through the return line 26, but flow can be artificially kept by injecting fluid at the top of the well bore and returning it through the chokes. In this case, since drilling fluid is intentionally lost to the formation during drilling, the method can only be used as a means of kick detection, and it would not be used to determine the formation fracture pressure or to detect loss of drilling fluid to the formation.

As mentioned above, whilst in this example, the oscillations applied to the auxiliary choke 32 give rise to generally sinusoidal waveforms, this need not be the case, and other wave forms or pulses can be applied. Indeed, it may be advantageous for the oscillations to give rise to more triangular peaks and troughs in BHP, as this may further assist in minimising the amount of formation fluid influx or mud loss in the event that the minimum BHP falls below the formation pore pressure or the peak BHP exceeds the formation fracture pressure.

It should be appreciated that, whilst in this example, an auxiliary choke 32 is used to provide the fluctuations in BHP, this need not be the case, and the main choke 30 may be used to do this. As such, it is not essential for the drilling system 10 include an auxiliary choke as described above, and the pressure oscillations can be applied any other way, for example by varying the rig pump speed.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of drilling a subterranean well bore using a tubular drill string, the method including the steps of injecting a drilling fluid into the well bore via the drill string and removing said drilling fluid from an annular space in the well bore around the drill string via a return line, wherein the method further includes progressively decreasing the mean pressure of fluid in the well bore whilst oscillating the pressure of the fluid in the annular space in the well bore, the amplitude of the pressure oscillations being maintained at a generally constant level, and monitoring the rate of flow of fluid along the return line.

2. A method according to claim 1 wherein the return line is provided with a choke which restricts the flow of fluid along the return line and which is operable to vary the degree to which the flow of fluid along the return line is restricted, and the oscillating of the pressure of the fluid in the annular space in the well bore is achieved by oscillating the choke to alternately increase and decrease the degree to which the flow of fluid along the return line is restricted.

3. A method according to claim 2 wherein the return line is provided with a main choke and an auxiliary choke, the auxiliary choke being located in a branch line which extends from the return line upstream of the main choke to the return line downstream of the main choke.

4. A method according to claim 3 wherein the oscillating of the pressure of the fluid in the well bore is preferably achieved by oscillating the auxiliary choke to alternately increase and decrease the degree to which the flow of fluid along the return line is restricted.

5. A method according to claim 1 wherein the rate of flow of the drilling fluid along the return line is monitored using a flow meter which is connected to a processor which records the rate of flow of fluid along the return line over time.

6. A method according to claim 5 wherein the flow meter is located in the return line upstream of the main choke.

7. A method according to claim 1 wherein the method further includes the steps of comparing the rate of flow of fluid along the return line when oscillating the pressure of the fluid in the well bore prior to drilling into a formation with the rate of flow of fluid along the return line when oscillating the pressure of the fluid in the well bore whilst drilling through a formation including a reservoir of formation fluid.

8. A method according to claim 1 wherein the method further includes the steps of, whilst drilling through a formation including a reservoir of formation fluid, progressively increasing the mean pressure of fluid in the well bore whilst oscillating the pressure of fluid in the well bore, the amplitude of the pressure oscillations being maintained at a generally constant level.

9. A method of drilling a subterranean well bore using a tubular drill string, the method including the steps of injecting a drilling fluid into the well bore via the drill string and removing said drilling fluid from an annular space in the well bore around the drill string via a return line, the return line having a main choke which restricts the flow of fluid along the return line and which is operable to vary the degree to which the flow of fluid along the return line is restricted, and the return line having an auxiliary choke, the auxiliary choke being located in a branch line which extends from the return line upstream of the main choke to the return line downstream of the main choke, wherein the method further includes oscillating the pressure of the fluid in the annular space in the well bore by oscillating at least one of the main choke and the auxiliary choke to alternately increase and decrease the degree to which the flow of fluid along the return line is restricted, and monitoring the rate of flow of fluid along the return line.

10. A method of drilling a subterranean well bore using a tubular drill string, the method including the steps of injecting a drilling fluid into the well bore via the drill string and removing said drilling fluid from an annular space in the well bore around the drill string via a return line, wherein the method further includes progressively increasing the mean pressure of the drilling fluid in the wellbore whilst oscillating the pressure of the fluid in the annular space in the well bore, the amplitude of the pressure oscillations being maintained at a generally constant level, and monitoring the rate of flow of fluid along the return line.

* * * * *